US010337079B2

(12) United States Patent
Sugiyama et al.

(10) Patent No.: US 10,337,079 B2
(45) Date of Patent: Jul. 2, 2019

(54) MARAGING STEEL

(71) Applicant: DAIDO STEEL CO., LTD., Nagoya-shi (JP)

(72) Inventors: Kenji Sugiyama, Nagoya (JP); Keita Hinoshita, Nagoya (JP); Hiroyuki Takabayashi, Nagoya (JP); Shigeki Ueta, Nagoya (JP)

(73) Assignee: DAIDO STEEL CO., LTD., Nagoya-Shi, Aichi (JP)

( * ) Notice: Subject to any disclaimer, the term of this patent is extended or adjusted under 35 U.S.C. 154(b) by 0 days.

(21) Appl. No.: 15/154,729

(22) Filed: May 13, 2016

(65) Prior Publication Data

US 2016/0340752 A1 Nov. 24, 2016

(30) Foreign Application Priority Data

May 22, 2015 (JP) ..... 2015-104464
Dec. 18, 2015 (JP) ..... 2015-247123

(51) Int. Cl.

| | |
|---|---|
| ***C22C 38/10*** | (2006.01) |
| ***C22C 38/44*** | (2006.01) |
| ***C22C 38/52*** | (2006.01) |
| ***C21D 6/02*** | (2006.01) |
| ***C21D 6/00*** | (2006.01) |
| ***C21D 6/04*** | (2006.01) |
| ***C22C 38/00*** | (2006.01) |
| ***C22C 38/02*** | (2006.01) |
| ***C22C 38/06*** | (2006.01) |
| ***C22C 38/46*** | (2006.01) |
| ***C22C 38/48*** | (2006.01) |
| ***C22C 38/50*** | (2006.01) |
| ***C22C 38/54*** | (2006.01) |
| ***C21D 1/25*** | (2006.01) |

(52) U.S. Cl.

CPC ..... *C21D 6/02* (2013.01); *C21D 1/25* (2013.01); *C21D 6/007* (2013.01); *C21D 6/04* (2013.01); *C22C 38/002* (2013.01); *C22C 38/02* (2013.01); *C22C 38/06* (2013.01); *C22C 38/10* (2013.01); *C22C 38/105* (2013.01); *C22C 38/44* (2013.01); *C22C 38/46* (2013.01); *C22C 38/48* (2013.01); *C22C 38/50* (2013.01); *C22C 38/52* (2013.01); *C22C 38/54* (2013.01); *C21D 2211/008* (2013.01)

(58) Field of Classification Search

CPC .... C21D 1/25; C21D 2211/008; C21D 6/007; C21D 6/02; C21D 6/04; C22C 38/002; C22C 38/02; C22C 38/06; C22C 38/10; C22C 38/105; C22C 38/44; C22C 38/46; C22C 38/48; C22C 38/50; C22C 38/52; C22C 38/54

See application file for complete search history.

(56) References Cited

U.S. PATENT DOCUMENTS

| | | | | |
|---|---|---|---|---|
| 3,262,777 | A * | 7/1966 | Sadowski | C22C 38/44 148/621 |
| 3,294,527 | A * | 12/1966 | Floreen | C22C 38/08 148/328 |
| 5,393,488 | A | 2/1995 | Rhoads et al. | |
| 5,866,066 | A | 2/1999 | Hemphill et al. | |
| 8,152,938 | B2 | 4/2012 | Montagnon et al. | |
| 8,153,056 | B2 | 4/2012 | Montagnon et al. | |
| 8,192,560 | B2 | 6/2012 | Montagnon et al. | |
| 9,506,125 | B2 | 11/2016 | Ueta et al. | |
| 2008/0193321 | A1 | 8/2008 | Montagnon et al. | |
| 2011/0041961 | A1 | 2/2011 | Montagnon et al. | |
| 2011/0048583 | A1 | 3/2011 | Montagnon et al. | |
| 2013/0327446 | A1 | 12/2013 | Ueta et al. | |

FOREIGN PATENT DOCUMENTS

| | | | |
|---|---|---|---|
| CN | 100580124 | C | 1/2010 |
| CN | 103484787 | A | 1/2014 |
| EP | 2 671 955 | A1 | 12/2013 |
| JP | 2002161342 | A * | 6/2002 |
| JP | 2011-195922 | A | 10/2011 |
| JP | 2014-012887 | A | 1/2014 |
| WO | WO 91/12352 | A1 | 8/1991 |

OTHER PUBLICATIONS

Extended European Search Resort dated Oct. 20, 2016.

Grujicic M: "Thermodynamics Aided Design of High Co—Ni Secondary Hardening Steels", CALPHAD. Computer Coupling of Phasediagrams and Thermochemistry, New York, NY, US, vol. 14, No. 1, Jan. 1, 1990 (Jan. 1, 1990), pp. 49-59, XP002050458, ISSN: 0364-5916, DOI: 10.1016/0364-5916(90)90039-3, pp. 49-59: figures 4-6: table 1.

Handerhan K J et al: "A Comparison of the Fracture Behavior or Two Heats of the Secondary Hardening Steel AF 1410", Metallurgical Transactions A. Physical Metallurgy and Materialsscience, Metallurgical Society of AIME. New York, US, vol. 20A, No. 1, Jan. 1, 1989 (Jan. 1, 1989), pp. 105-123, XP002050457, pp. 105-123; table I.

(Continued)

*Primary Examiner* — Colleen P Dunn

*Assistant Examiner* — Anthony M Liang

(74) *Attorney, Agent, or Firm* — McGinn I.P. Law group, PLLC.

(57) ABSTRACT

The present invention relates to a maraging steel containing, in terms of mass %, 0.20≤C≤0.35, 9.0≤Co≤20.0, 1.0≤(Mo+W/2)≤2.0, 1.0≤Cr≤4.0, and a certain amount of Ni, with the balance being Fe and inevitable impurities, in which in a case where the contents of V and Nb satisfy V+Nb≤0.020 mass %, the amount of Ni is 6.0≤Ni≤9.4, and in which in a case where the contents of V and Nb satisfy 0.020 mass %<V+Nb≤0.60 mass %, the amount of Ni is 6.0≤Ni≤16.0.

15 Claims, No Drawings

(56) References Cited

OTHER PUBLICATIONS

Chinese Office Action, dated Jan. 3, 2018, in Chinese Application No. 201610345295.5 and English Translation thereof.
Chinese Office Action, dated Jan. 3, 2018, in Chinese Application No. 201610345305.5 and English Translation thereof.
United States Office Action dated Sep. 13, 2017 in co-pending U.S. Appl. No. 15/154,737.
United States Office Action dated Apr. 24, 2018 in U.S. Appl. No. 15/154,737.
United States Advisory Action dated Jul. 20, 2018 in co-pending U.S. Appl. No. 15/154,737.
European Office Action, dated Sep. 25, 2018, in European Patent Application No. 16170618.9.
Chinese Office Action, dated Oct. 31, 2018, in Chinese Application No. 2016103452955 and English Translation thereof.
United States Office Action dated Oct. 29, 2018 in U.S. Appl. No. 15/154,737.
European Office Action dated Feb. 15, 2019 in European Application No. 16170618.9.
Notice of Allowance dated Apr. 1, 2019 in co-pending U.S. Appl. No. 15/154,737.
Chinese Office Action dated May 8, 2019 in Chinese Patent Application No. 201610345295.5 with an English Translation.

* cited by examiner

MARAGING STEEL

FIELD OF THE INVENTION

The present invention relates to a maraging steel, and more specifically, it relates to a maraging steel has high strength and excellent toughness and ductility, and is usable for engine shafts and the like.

BACKGROUND OF THE INVENTION

Maraging steels are carbon-free or low-carbon steels, and are obtained by subjecting steels containing Ni, Co, Mo, Ti and like elements in high proportions to solution heat treatment and then to quenching and aging treatment.

Maraging steels have characteristics including (1) good machinability attributable to formation of soft martensite in a quenched stage, (2) very high strength attributable to precipitation of intermetallic compounds, such as $Ni_3Mo$, $Fe_2Mo$ and $Ni_3Ti$, in martensite texture through aging treatment, and (3) high toughness and ductility in spite of its high strength.

Maraging steels have therefore been used as structural materials (e.g. engine shafts) for spacecraft and aircraft, structural materials for automobiles, materials for high-pressure vessels, materials for tools, and so on.

So far, Maraging steels (e.g., 18Ni maraging steels/Fe-18Ni-9Co-5Mo-0.5Ti-0.1Al of Grade 250 ksi (1724 MP)) having high strength and excellent toughness and ductility, have been used for engine shafts of aircraft. However, with the recent demand of improving air pollution by, for example, tightening control on exhaust gas emission, enhancement of efficiency has been required of aircraft also. From the viewpoint of designing engines, there have been increasing demands for high-strength materials capable of enduring high power, downsizing and weight reduction.

As a material having more excellent characteristics than the maraging steels of Grade 250 ksi, there exists GE1014 (tensile strength: on the order of 2,200 MPa) developed by General Electric Company (Patent Document 1), but much higher strength (tensile strength: 2,300 MPa or higher) has been thought to be necessary.

In addition, low-cycle fatigue characteristics are also important, and control of inclusions becomes important because the starting point of fatigue fracture is governed by the chemical species and shape of inclusions.

In order to solve this problem, various suggestions have been offered.

For example, Patent Document 2 has disclosed a steel containing 0.18 to 0.30 weight % of C, 5 to 7 weight % of Co, 2 to 5 weight % of Cr, 1 to 2 weight % of Al, 1 to 4 weight % of Mo+W/2, at most 0.3 weight % of V, at most 0.1 weight % of Nb, at most 50 ppm of B, 10.5 to 15 weight % of Ni, at most 0.4 weight % of Si, at most 0.4 weight % of Mn, at most 500 ppm of Ca, at most 500 ppm of rate earth elements, at most 500 ppm of Ti, at most 200 ppm of O, at most 100 ppm of N, at most 50 ppm of S, at most 1 weight % of Cu, and at most 200 ppm of P, with the balance being Fe and inevitable impurities.

The material disclosed in the document cited above has a high strength on the order of 2,300 MPa. However, it has a high Ni content of 10.5 weight % or more and a low Co content of 7 weight % or less, and hence it still has room for further improvement in strength. In addition, the material disclosed in the document cited above is an Al-added steel, and therefore it is conceived that AlN is formed as an inclusion which affects low-cycle fatigue characteristics and carries a potential for deterioration of low-cycle fatigue characteristics.

Patent Document 3 has disclosed a maraging steel containing 0.10 to 0.30 mass % of C, 6.0 to 9.4 mass % of Ni, 11.0 to 20.0 mass % of Co, 1.0 to 6.0 mass % of Mo, 2.0 to 6.0 mass % of Cr, 0.5 to 1.3 mass % of Al, and at most 0.1 mass % of Ti, with the balance being Fe and inevitable impurities, and besides, which satisfies a relational expression 1.0≤A value≤1.08.

The material disclosed in the document cited above has a high tensile strength on the order of 2,400 MPa, but it is an Al-added steel as is the case with the material disclosed in Patent Document 2. Thus it is conceived that AlN is formed as an inclusion which affects low-cycle fatigue characteristics and carries a potential for deterioration of low-cycle fatigue characteristics.

Further, Patent Document 4 has disclosed an age hardenable martensitic steel containing 0.21 to 0.34 weight % of C, at most 0.20 weight % of Mn, at most 0.1 weight % of Si, at most 0.008 weight % of P, at most 0.003 weight % of S, 1.5 to 2.80 weight % of Cr, 0.90 to 1.80 weight % of Mo, 10 to 13 weight % of Ni, 14.0 to 22.0 weight % of Co, at most 0.1 weight % of Al, at most 0.05 weight % of Ti, at most 0.030 weight % of Ce, and at most 0.010 weight % of La, with the balance being Fe.

The material disclosed in the document cited above has a high strength of at least 2,300 MPa. However, such a material has not undergone addition of Al, and there is no factor for strength boost resulting from precipitation of a NiAl phase. Such being the case, addition of Ni in an amount of 10 weight % or more is not commensurate with various characteristics attained. Furthermore, the material disclosed in the document cited above contains Ce and the like for the purpose of inhibiting sulfide formation, on the contrary, there is a fear that the sulfides of those elements will form a starting point and easily induce fatigue fracture.

Patent Document 1: U.S. Pat. No. 5,393,488
Patent Document 2: U.S. A-2008/0193321
Patent Document 3: JP-A-2014-12887
Patent Document 4: U.S. Pat. No. 5,866,066

SUMMARY OF THE INVENTION

A problem that the present invention is to solve consists in providing maraging steels each of which has a tensile strength of 2,300 MPa or higher and excels in toughness, ductility and fatigue characteristics.

The gist of a maraging steel according to the present invention which aims to solve the above problem consists in consisting of:

as essential components,
- 0.20 mass %≤C≤0.35 mass %,
- 9.0 mass %≤Co≤20.0 mass %,
- 1.0 mass %≤(Mo+W/2)≤2.0 mass %,
- 1.0 mass %≤Cr≤4.0 mass %, and
- a certain amount of Ni, and as optional components,
- Al≤0.10 mass %,
- Ti≤0.10 mass %,
- S≤0.0010 mass %,
- N≤0.0020 mass %,
- V+Nb≤0.60 mass %,
- B≤0.0050 mass %,
- Si≤1.0 mass %,
- Mg≤0.0030 mass %, and
- Ca≤0.0030 mass %, with the balance being Fe and inevitable impurities, in which in a first case where the contents of V and Nb satisfy V+Nb≤0.020 mass %, the amount of Ni is: 6.0 mass %≤Ni≤9.4 mass %, and in which in a second case where the contents of V and Nb satisfy 0.020 mass %<V+Nb≤0.60 mass %, the amount of Ni is: 6.0 mass %≤Ni≤16.0 mass %.

The maraging steel preferably has a tensile strength of at least 2,300 MPa at room temperature (23° C.), and preferably has an elongation of at least 8% at room temperature (23° C.).

Since the maraging steels according to the present invention is substantially free of Al and Ti, it can be prevented the reduction in low-cycle fatigue strength, which comes from formation of AlN and/or TiN. On the other hand, the maraging steels according to the present invention cannot get a rise in strength coming from precipitation of a NiAl phase because of their lack of Al. However, the content ranges of constituent elements in the steel are optimized so as to ensure precipitation of carbides (e.g., Mo carbides and Cr carbides) in appropriate amounts, and thereby it becomes possible to obtain maraging steels having not only high fatigue characteristics but also high tensile strength and high elongation.

DETAILED DESCRIPTION OF THE INVENTION

Embodiments of the present invention are described below in detail.

[1. Maraging Steel]

[1.1. Primary Constituent Elements]

Each of the maraging steels according to embodiments of the present invention contains elements in their respective content ranges as mentioned below, with the balance being Fe and inevitable impurities. Kinds and content ranges of added elements and reasons for limitations thereon are as follows.

(1) 0.20 Mass %≤C≤0.35 Mass %

C has a precipitation strengthening action through the formation of carbides, and exerts significant control over strength characteristics. The carbides formed herein are Cr compounds and Mo compounds. In order to ensure such an effect, the C content is required to be at least 0.20 mass %. The C content is adjusted preferably to 0.30 mass % or more.

On the other hand, in the case where the C content is excessively high, rise in strength becomes excessive to result in significant impairment of toughness and ductility. Accordingly, the C content is required to be at most 0.35 mass %. The C content is adjusted preferably to 0.33 mass % or less.

(2.1) 6.0 Mass %≤Ni≤9.4 Mass % (the Maraging Steel of the First Case where V+Nb≤0.020 Mass %)

Ni can enhance toughness and ductility through the formation of solid solution in the matrix. In order to ensure such an effect in the case where the total for V and Nb contents is 0.020 mass % or less, the Ni content is required to be at least 6.0 mass %. The Ni content is adjusted preferably to 7.0 mass % or more.

On the other hand, in the case where the Ni content becomes excessive, lowering of Ms point occurs, and the amount of residual austenite is increased and satisfactory martensitic structure cannot be formed. Even in the case of containing more than 9.4 mass % of Ni, satisfactory martensitic structure may be achieved by repeatedly performing a sub-zero treatment. However, such repetition causes an increase in manufacturing cost. Accordingly, the Ni content is required to be at most 9.4 mass %. The Ni content is adjusted preferably to 9.0 mass % or less.

(2.2) 6.0 Mass %≤Ni≤16.0 Mass % (the Maraging Steel of the Second Case where 0.020 Mass %≤V+Nb≤0.60 Mass %)

In the other case where the total for V and Nb contents is more than 0.020 mass %, the Ni content is required to be at least 6.0 mass % for the purpose of producing the effect mentioned above. The Ni content is adjusted preferably to 7.0 mass % or more.

In the case where the total content of V and Nb is more than 0.020 mass %, strength enhancement becomes possible through the pinning effect of V carbide or Nb carbide. Therefore the Ni content can be adjusted to 16.0 mass % or less. The Ni content is adjusted preferably to 14.5 mass % or less.

(3) 9.0 Mass %≤Co≤20.0 Mass %

If Co is made to remain in a state of solid solution in the matrix, it becomes possible to reduce the dissolved amounts of carbide-forming elements, such as Cr and Mo, in martensite, resulting in promotion of M2C-type precipitation. As a result, both tensile strength and fatigue strength can be enhanced. In order to ensure such effects, the Co content is required to be at least 9.0 mass %. The Co content is adjusted preferably to 11.5 mass % or more, and far preferably to 13.0 mass % or more. By adjusting the Co content to fall in such ranges, even in the case where the total for V and Nb contents is 0.020 mass % or less, the maraging steels obtained become superior in not only strength but also fracture toughness characteristics (e.g. 35 MPa√lm or higher).

On the other hand, in the case where the Co content is excessively high, the strength becomes too high, and thereby the ductility becomes significantly low. In addition, an increase in cost is brought about because Co is expensive. Accordingly, the Co content is required to be at most 20.0 mass %. The Co content is adjusted preferably to 18.0 mass % or less.

(4.1) 1.0 Mass %≤(Mo+W/2)≤2.0 Mass % (in the Case of Using Either Mo or W, or Both)

W forms a W-containing carbide such as $W_2C$ and contributes to enhancement of matrix strength as is the case with the Mo-containing carbide mentioned above. Accordingly, part or all of Mo can be replaced with W. However, the strength enhancement effect produced by addition of W is about ½, on a mass % basis, that produced by addition of Mo. Thus the total for Mo and W contents is required to be 1.0 mass % or more in terms of (Mo+W/2).

On the other hand, in the case where the Mo and W contents are excessively high, it becomes necessary to perform heat treatment at higher temperatures in order that carbides, such as $Mo_2C$ and $W_2C$, precipitating out under solidification can be converted into solid solution, thereby resulting in excessive increase in prior austenite grain size. Consequently, the optimum temperature range for inhibiting coarsening of prior austenite grain size and dissolving the carbides becomes narrow. The decreasing of elongation is due to coarsening of prior austenite grain size and carbides which remain after solution treatment. Accordingly, the total for Mo and W contents is required to be at most 2.0 mass % in terms of (Mo+W/2). The total for Mo and W contents is adjusted preferably to 1.8 mass % or less, and far preferably to 1.6 mass % or less, in terms of (Mo+W/2).

Incidentally, in the case where both Mo and W are included, Mo≥0.40 mass % is appropriate for a reason that it allows the securing of an increment in matrix strength by precipitation of intermetallic compounds such as $Ni_3Mo$.

(4.2) 1.0 Mass %≤Mo≤2.0 Mass % (in the Case of Using Mo by Itself)

Mo contributes to enhancement of strength characteristics through the formation of carbides. In the case of using Mo by itself, the Mo content is required to be at least 1.0 mass % in order to ensure such an effect.

On the other hand, in case that Mo content is excessively high, the solvus treatment of precipitated carbide becomes higher. Therefore the heat treatment becomes difficult in terms of inhibiting coarsening of prior austenite grain size and dissolving the carbides. In addition, the diffusion of Mo is slow, thereby incurring serious embrittlement due to remaining segregation. In the case where the Mo content is higher than 2.0 mass %, embrittlement arising from segregation is aggravated. Therefore the Mo content is required to be at most 2.0 mass %. The Mo content is adjusted preferably to 1.8 mass % or less.

(4.3) 2.0 Mass %≤W≤4.0 Mass % (in the Case of Using W by Itself)

For the same reasons as in the case of Mo, the appropriate W content in the case of using W by itself is 2.0 mass % or more.

In addition, for the same reasons as in the case of Mo, the appropriate W content is 4.0 mass % or less, and preferably 3.6 mass % or less.

(5) 1.0 Mass %≤Cr≤4.0 Mass %

Cr also contributes to, as is the case with Mo, enhancement of strength characteristics through the formation of carbides, In order to ensure such an effect, the Cr content is required to be at least 1.0 mass %. The Cr content is adjusted preferably to 2.0 mass % or more.

On the other hand, in the case where the Cr content is excessively high, ductility is improved, but tensile strength is reduced, which makes it impossible to achieve high strength as a feature of maraging steels. Accordingly, the Cr content is required to be at most 4.0 mass %. The Cr content is adjusted preferably to 3.5 mass % or less.

(6) Al≤0.10 Mass % (0 Mass %≤Al≤0.10 Mass %)

Al forms NiAl as an intermetallic compound and contributes to enhancement of strength, but it forms AlN. In the case where AlN is present, fatigue property becomes bad due to stress concentration around AlN. Accordingly, the Al content is required to be at most 0.10 mass %. The Al content is adjusted preferably to 0.050 mass % or less. The Al content may be zero (Al=0 mass %).

(7) Ti≤0.10 Mass % (0 Mass %≤Ti≤0.10 Mass %)

Ti also contributes to, as is the case with Al, enhancement of strength through the formation of intermetallic compounds, but it forms TiN. In the case where TiN is present, fatigue property becomes bad due to stress concentration around TiN. Accordingly, the Ti content is required to be at most 0.10 mass %. And the Ti content is adjusted preferably to 0.010 mass % or less. The Ti content may be zero (Ti=0 mass %).

(8) S≤0.0010 Mass % (0 Mass %≤S≤0.0010 Mass %)

S is an impurity, and coarse grain sulfides are formed if the S content is high. Formation of sulfides not only leads to deterioration in fatigue characteristics but also brings about reduction in tensile strength. Accordingly, the S content is required to be at most 0.0010 mass %. The S content may be zero (S=0 mass %).

(9) N≤0.0020 mass % (0 mass %≤N≤0.0020 mass %)

N is an impurity, and in the case of a high N content, AlN and TiN are formed even when the Al or Ti content is reduced. Formation of nitrides leads to deterioration in fatigue characteristics. Accordingly, the N content is required to be at most 0.0020 mass %. The N content may be zero (N=0 mass %).

[1.2. Secondary Constituent Elements]

In addition to the primary constituent elements mentioned above, each of the maraging steels according to embodiments of the present invention can further contain elements as mentioned below. Kinds and content ranges of added elements and reasons for limitations thereon are as follows.

(10) V and Nb: V+Nb≤0.60 mass % (0 mass %≤V+Nb≤0.60 mass %)

(10.1) 0.020 mass %≤V+Nb≤0.60 mass % (the maraging steel of the second case where 0.020 mass %≤V+Nb≤0.60 mass %)

In the present invention, even in the case where the total for V and Nb contents is 0.020 mass % or less, sufficient tensile strength and fatigue strength can be secured. However, by incorporation of specified amounts of V and/or Nb, M2C type carbides are formed, and they not only contribute to enhancement of tensile strength but also conduce to improvement in hydrogen embrittlement characteristics. Moreover, incorporation of V and/or Nb produces the effect of fining crystal grains through the pinning effect of the M2C type carbides. In order to ensure these effects, it is appropriate that the total for V and Nb contents be higher than 0.020 mass %.

On the other hand, in the case where the total for V and Nb contents is excessively high, the total amount of Mo and Cr carbides formed is reduced, and thereby the tensile strength is lowered. Accordingly, it is appropriate that the total for V and Nb contents be 0.60 mass % or less.

(10.2) 0.10 Mass %≤V≤0.60 Mass %

In the present invention, even in the case where the V content is 0.020 mass % or less, sufficient tensile strength and fatigue strength can be secured. However, by incorporation of V in a specified amount or more, M2C type carbide is formed, and it not only contributes to enhancement of tensile strength but also conduces to improvement in hydrogen embrittlement characteristics. Further, incorporation of V produces the effect of fining crystal grains through the pinning effect of M2C type carbide. In addition, incorporation of V ensures excellent fracture toughness characteristics. In order to ensure these effects, it is appropriate that the V content be 0.10 mass % or more.

On the other hand, in the case where the V content is excessively high, the total amount of Mo and Cr carbides formed is reduced, and thereby the tensile strength is lowered. Accordingly, it is appropriate that the V content be 0.60 mass % or less.

(10.3) 0.10 mass %≤Nb≤0.60 mass %

As with V, even in the case where the Nb content is 0.020 mass % or less, sufficient tensile strength and fatigue strength can be secured. However, by incorporation of Nb in a specified amount or more, M2C type carbide is formed and it not only contributes to enhancement of tensile strength but also conduces to improvement in hydrogen embrittlement characteristics. Further, incorporation of Nb produces the effect of fining crystal grains through the pinning effect of M2C type carbide. In addition, incorporation of Nb ensures excellent fracture toughness characteristics. In order to ensure these effects, it is appropriate that the Nb content be 0.10 mass % or more.

On the other hand, in the case where the Nb content is excessively high, the total amount of Mo and Cr carbides formed is reduced, and thereby the tensile strength is lowered. Accordingly, it is appropriate that the Nb content be 0.60 mass % or less.

(11) 0 Mass %≤B≤0.0050 Mass % (0.0010 Mass %≤B≤0.0050 Mass %)

B may be added because it is an element effective in improving hot workability of steel. In addition, incorporation of B conduces to improvement in toughness and ductility. This is because B brings about segregation within the grain boundary and inhibits segregation of Si and Mn within the grain boundary. The B content may be zero (B=0 mass %), but in order to ensure these effects, it is appropriate that the B content be adjusted to 0.001 mass % or more.

On the other hand, in the case where the B content is excessively high, B combines with N to form BN and degrades toughness and ductility. Accordingly, it is appropriate that the B content be at most 0.0050 mass %.

(12) 0 Mass %≤Si≤1.0 Mass % (0.30 Mass %≤Si≤1.0 Mass %)

Si acts as a deoxidizing agent during melting process, and lessens oxygen included as an impurity. In addition, Si contributes to enhancement of tensile strength through the solid solution strengthening. The Si content may be zero (Si=0 mass %), but in order to ensure these effects, it is appropriate that the Si content be 0.3 mass % or more.

On the other hand, too high Si content not only brings about lowering of hot workability to result in aggravation of fracture in the forging process but also makes the strength excessively high to result in lowering of toughness and ductility. Accordingly, it is appropriate that the Si content be at most 1.0 mass %.

(13) Mg≤0.0030 mass % (0 mass %≤Mg≤0.0030 mass %)

(14) Ca≤0.0030 mass % (0 mass %≤Ca≤0.0030 mass %)

Mg and Ca are both elements effective in improving hot workability, and hence they may be added. Either Mg or Ca, or both may be added.

However, excessive addition of these elements degrades the cleanliness of steel through the formation of their oxides to result in lowering of fatigue strength. Accordingly, it is appropriate that the contents of these elements be independently adjusted to at most 0.0030 mass %.

[1.3. Inclusions]

By optimizing constituent elements and manufacturing conditions, it becomes possible to obtain maraging steels which are free of AlN and TiN inclusions measuring 05 μm or larger in maximum diameter.

Herein, the expression of "free of AlN and TiN inclusions measuring ϕ5 μm or larger in maximum diameter" means that when 5 g of a test specimen is dissolved chemically and filtered through a filter having a pore size of ϕ5 μm, neither AlN nor TiN is left on the filter.

[1.4. Characteristics]

By optimizing constituent elements and manufacturing conditions, it becomes possible to obtain maraging steels each of which has a tensile strength of at least 2,300 MPa at room temperature (23° C.) and an elongation of at least 8% at room temperature (23° C.).

[1.5. Uses]

The maraging steels according to the present invention can be used for various applications. For example, the maraging steels according to the present invention are suitable as engine shafts of aircraft in particular.

[2. Manufacturing Method for Maraging Steel]

A manufacturing method for maraging steels according to the present invention contains a melting step, a re-melting step, a homogenizing step, a forging step, a solution heat treatment step, a sub-zero treatment step and an aging treatment step.

[2.1. Melting Step]

The melting step is a step of melting and casting a raw material prepared by mixing constituent elements in respectively-specified content ranges. The raw material to be used has no particular restrictions as to its background and conditions for melting and casting thereof, and it can be selected from those best suited for intended purposes. For the obtainment of maraging steels exceling in strength and fatigue resistance in particular, cleanliness enhancement of the steels is favorable. For achievement of such a purpose, it is appropriate that the melting of a raw material be carried out under vacuum (e.g. by a method of using a vacuum induction melting furnace).

[2.2. Re-melting Step]

The re-melting step is a step in which the ingot obtained in the melting step is subjected to melting and casting once again. This step is not necessarily required, but steel's cleanliness can be further enhanced by carrying out re-melting, and thereby the fatigue resistance of steel is improved. For achievement of such effects, it is appropriate that the re-melting be carried out under vacuum (e.g. according to a vacuum arc re-melting method), and besides, it be repeated several times.

[2.3. Homogenizing Step]

The homogenizing step is a step of heating the ingot obtained in the melting step or the re-melting step at a specified temperature. The heat treatment for homogenization is carried out for the purpose of removing segregation having occurred during the casting. Heat treatment conditions for homogenization are not particularly limited, and any conditions will do, as long as they allow elimination of solidifying segregation. As to the heat treatment conditions for homogenization, the heating temperature is generally from 1,150° C. to 1,350° C., and the heating time is generally at least 10 hours. The ingot after the heat treatment for homogenization is generally air-cooled or sent off to the next step as it is in a red hot state.

[2.4. Forging Step]

The forging step is a step in which the ingot after the heat treatment for homogenization is forged into a predetermined shape. The forging is generally carried out in a hot state. As to the hot forging conditions, the heating temperature is generally from 900° C. to 1,350° C., the heating time is generally at least one hour and the termination temperature is generally 800° C. or higher. The method for cooling after hot forging has no particular restrictions. The hot forging may be carried out at a time, or it may be divided into 4 to 5 steps and performed in succession.

After the forging, annealing is done as required. As to the annealing conditions in ordinary cases, the heating temperature is from 550° C. to 950° C., the heating time is from 1 hour to 36 hours, and the cooling method is air cooling.

[2.5. Solution Heat Treatment Step]

The solution heat treatment step is a step of heating the steel worked into the predetermined shape at a specified temperature. This step is carried out for the purpose of transforming the matrix into the γ-phase alone, and besides dissolving precipitated carbides such as Mo carbides. For the solution heat treatment, optimum conditions are selected in response to the steel composition. As to the conditions for solution heat treatment in ordinary cases, the heating temperature is from 800° C. to 1,200° C., the heating time is from 1 hour to 10 hours and the cooling method is air cooling (AC), blast cooling (BC), water cooling (WC) or oil cooling (OC).

[2.6. Sub-Zero Treatment]

The sub-zero treatment is a step for cooling the steel after having received the solution heat treatment to room temperature (23° C.) or lower. This treatment is carried out for the purpose of transforming the remaining γ-phase into the martensite phase. Maraging steels are low in Ms point, and hence a great quantity of γ-phase usually remains at the time of cooling the steels to room temperature (23° C.). Even if maraging steels are subjected to aging treatment as a great quantity of γ-phase remains therein, there will be no expectation of significant increase in strength. Thus it becomes necessary to transform the remaining γ-phase into the martensite phase by performing the sub-zero treatment after the solution heat treatment. As to conditions for the sub-zero treatment in ordinary cases, the cooling temperature is from −197° C. to −73° C. and the cooling time is from 1 hour to 10 hours.

[2.7. Aging Treatment]

The aging treatment is a step for subjecting the steel having been transformed into the martensite phase to heating at a specified temperature. This treatment is carried out for the purpose of precipitating carbides such as $Mo_2C$. For the aging treatment, optimum conditions are selected according to the steel composition. As to the conditions for aging treatment in ordinary cases, the aging treatment temperature is from 400° C. to 600° C., the aging treatment time is from 0.5 hour to 24 hours and the cooling method is air cooling.

[3. Action]

Since the maraging steels according to the present invention is substantially free of Al and Ti, it can be prevented the reduction in low-cycle fatigue strength, which comes from formation of AlN and/or TiN. On the other hand, the maraging steels according to the present invention cannot get a rise in strength coming from precipitation of a NiAl phase because of their lack of Al. However, the content ranges of constituent elements in the steel are optimized so as to ensure precipitation of carbides (e.g., Mo carbides and Cr carbides) in appropriate amounts, and thereby it becomes possible to obtain maraging steels having not only high fatigue characteristics but also high tensile strength and high elongation.

EXAMPLES

Examples 1 to 28 and Comparative Examples 1 to 20

[1. Preparation of Test Specimens]

Each of alloys having the compositions shown in Table 1 and Table 2 were melted with vacuum induction melting furnace (VIF) and cast into 50 kg of steel ingot. Each of the thus obtained VIF steel ingots was subjected to homogenization treatment under the condition of 1,200° C.×20 hours. After the treatment, part of each steel ingot was forged into square bars measuring 70 mm per side for use as fracture toughness test specimens and the remainder was forged into round bars measuring ϕ22 for use as other test specimens. After the forging, all the test specimens were subjected to annealing treatment under the condition of 650° C.×16 hours for the purpose of softening them.

Then, solution conversion treatment under conditions of 930° C.×1 hour/air cooling, sub-zero treatment under conditions of −100° C.×1 hour and aging treatment under conditions of 450° C.×9 hours were carried out in sequence.

By the way, where B contents shown in Table 1 and Table 2 are concerned, the expression of "<0.001" means that the B content is less than the detection limit.

TABLE 1

| | Composition (mass %) | | | | | | | | | | | | | | |
|---|---|---|---|---|---|---|---|---|---|---|---|---|---|---|---|
| | C | Si | S | Ni | Cr | Mo | Co | Ti | Al | V | Nb | B | W | Mo + W/2 | Fe |
| Ex. 1 | 0.22 | 0.01 | 0.0004 | 8.3 | 2.3 | 1.4 | 15.1 | 0.002 | 0.002 | 0.01 | 0.01 | <0.001 | 0.01 | 1.4 | balance |
| Ex. 2 | 0.30 | 0.01 | 0.0004 | 8.3 | 2.4 | 1.9 | 20.0 | 0.002 | 0.002 | 0.01 | 0.01 | <0.001 | 0.01 | 1.9 | balance |
| Ex. 3 | 0.33 | 0.02 | 0.0005 | 8.8 | 2.2 | 1.4 | 15.0 | 0.002 | 0.002 | 0.01 | 0.01 | <0.001 | 0.01 | 1.4 | balance |
| Ex. 4 | 0.30 | 0.01 | 0.0005 | 8.5 | 2.3 | 1.6 | 18.6 | 0.002 | 0.002 | 0.01 | 0.01 | <0.001 | 0.01 | 1.6 | balance |
| Ex. 5 | 0.32 | 0.07 | 0.0005 | 8.8 | 2.2 | 1.4 | 15.4 | 0.002 | 0.002 | 0.01 | 0.01 | <0.001 | 0.01 | 1.4 | balance |
| Ex. 6 | 0.34 | 0.02 | 0.0007 | 8.7 | 3.0 | 1.4 | 15.0 | 0.002 | 0.002 | 0.01 | 0.01 | <0.001 | 0.01 | 1.4 | balance |
| Ex. 7 | 0.33 | 0.01 | 0.0005 | 6.7 | 2.5 | 1.4 | 17.5 | 0.002 | 0.002 | 0.01 | 0.01 | <0.001 | 0.01 | 1.4 | balance |
| Ex. 8 | 0.32 | 0.01 | 0.0005 | 8.3 | 3.1 | 1.6 | 15.0 | 0.002 | 0.002 | 0.01 | 0.01 | <0.001 | 0.01 | 1.6 | balance |
| Ex. 9 | 0.27 | 0.01 | 0.0003 | 9.0 | 1.0 | 1.6 | 15.0 | 0.002 | 0.002 | 0.01 | 0.01 | <0.001 | 0.01 | 1.6 | balance |
| Ex. 10 | 0.32 | 0.01 | 0.0003 | 8.5 | 2.3 | 1.7 | 15.3 | 0.002 | 0.002 | 0.01 | 0.01 | <0.001 | 0.01 | 1.7 | balance |
| Ex. 11 | 0.30 | 0.01 | 0.0003 | 8.7 | 2.2 | 1.3 | 17.5 | 0.002 | 0.002 | 0.01 | 0.01 | <0.001 | 0.01 | 1.3 | balance |
| Ex. 12 | 0.30 | 0.01 | 0.0004 | 8.8 | 2.0 | 1.7 | 15.0 | 0.002 | 0.002 | 0.01 | 0.01 | <0.001 | 0.01 | 1.7 | balance |
| Ex. 13 | 0.30 | 0.02 | 0.0005 | 8.5 | 2.4 | 1.4 | 13.5 | 0.002 | 0.002 | 0.01 | 0.01 | <0.001 | 0.01 | 1.4 | balance |
| Ex. 14 | 0.32 | 0.02 | 0.0004 | 8.8 | 2.5 | 1.4 | 17.9 | 0.002 | 0.002 | 0.01 | 0.01 | <0.001 | 0.01 | 1.4 | balance |
| Ex. 15 | 0.30 | 0.01 | 0.0003 | 8.5 | 2.2 | 1.3 | 19.3 | 0.002 | 0.002 | 0.01 | 0.01 | <0.001 | 0.01 | 1.3 | balance |
| Ex. 16 | 0.30 | 0.04 | 0.0004 | 8.7 | 2.4 | 1.4 | 15.6 | 0.002 | 0.002 | 0.01 | 0.01 | <0.001 | 0.01 | 1.4 | balance |
| Ex. 17 | 0.33 | 0.01 | 0.0004 | 8.3 | 2.5 | 1.3 | 15.0 | 0.002 | 0.002 | 0.01 | 0.01 | <0.001 | 0.01 | 1.3 | balance |
| Ex. 18 | 0.32 | 0.04 | 0.0003 | 8.8 | 2.3 | 1.3 | 17.5 | 0.002 | 0.002 | 0.01 | 0.01 | <0.001 | 0.01 | 1.3 | balance |
| Ex. 19 | 0.30 | 0.01 | 0.0004 | 8.8 | 2.5 | 1.3 | 15.0 | 0.002 | 0.002 | 0.10 | 0.01 | <0.001 | 0.01 | 1.3 | balance |
| Ex. 20 | 0.30 | 0.01 | 0.0004 | 8.7 | 2.4 | 1.4 | 15.2 | 0.002 | 0.002 | 0.20 | 0.01 | <0.001 | 0.01 | 1.4 | balance |
| Ex. 21 | 0.32 | 0.04 | 0.0003 | 8.3 | 2.4 | 1.4 | 15.8 | 0.002 | 0.002 | 0.01 | 0.01 | <0.001 | 0.01 | 1.4 | balance |
| Ex. 22 | 0.29 | 0.01 | 0.0003 | 8.0 | 2.4 | 1.4 | 15.0 | 0.002 | 0.002 | 0.01 | 0.1 | <0.001 | 0.01 | 1.4 | balance |
| Ex. 23 | 0.30 | 0.02 | 0.0005 | 8.7 | 2.4 | 1.4 | 17.5 | 0.002 | 0.002 | 0.01 | 0.01 | <0.001 | 0.01 | 1.4 | balance |
| Ex. 24 | 0.32 | 0.02 | 0.0003 | 8.3 | 2.3 | 1.4 | 15.0 | 0.002 | 0.002 | 0.01 | 0.01 | 0.003 | 0.01 | 1.4 | balance |
| Ex. 25 | 0.29 | 0.01 | 0.0003 | 8.8 | 2.4 | 1.4 | 9.5 | 0.002 | 0.002 | 0.01 | 0.01 | <0.001 | 0.01 | 1.4 | balance |
| Ex. 26 | 0.30 | 0.50 | 0.0003 | 8.9 | 2.4 | 1.4 | 15.1 | 0.002 | 0.002 | 0.01 | 0.01 | <0.001 | 0.01 | 1.4 | balance |
| Ex. 27 | 0.29 | 0.04 | 0.0003 | 8.8 | 2.4 | 1.4 | 14.9 | 0.002 | 0.002 | 0.01 | 0.01 | <0.001 | 0.6 | 1.7 | balance |
| Ex. 28 | 0.32 | 0.04 | 0.0003 | 8.7 | 2.4 | 0.6 | 15.0 | 0.002 | 0.002 | 0.01 | 0.01 | <0.001 | 1.6 | 1.4 | balance |

TABLE 2

| | Composition (mass %) | | | | | | | | | | | | | | |
|---|---|---|---|---|---|---|---|---|---|---|---|---|---|---|---|
| | C | Si | S | Ni | Cr | Mo | Co | Ti | Al | V | Nb | B | W | Mo + W/2 | Fe |
| Comp. Ex. 1 | 0.14 | 0.02 | 0.0003 | 8.8 | 2.4 | 1.3 | 15.0 | 0.002 | 0.002 | 0.01 | 0.01 | <0.001 | 0.01 | 1.3 | balance |
| Comp. Ex. 2 | 0.43 | 0.01 | 0.0004 | 8.7 | 2.0 | 1.4 | 15.3 | 0.002 | 0.002 | 0.01 | 0.01 | <0.001 | 0.01 | 1.4 | balance |
| Comp. Ex. 3 | 0.29 | 1.30 | 0.0003 | 8.7 | 2.2 | 1.3 | 15.3 | 0.002 | 0.002 | 0.01 | 0.01 | <0.001 | 0.01 | 1.3 | balance |
| Comp. Ex. 4 | 0.33 | 0.02 | 0.004 | 8.5 | 2.2 | 1.3 | 15.3 | 0.002 | 0.002 | 0.01 | 0.01 | <0.001 | 0.01 | 1.3 | balance |
| Comp. Ex. 5 | 0.33 | 0.02 | 0.0003 | 5.0 | 2.4 | 1.4 | 15.0 | 0.002 | 0.002 | 0.01 | 0.01 | <0.001 | 0.01 | 1.4 | balance |
| Comp. Ex. 6 | 0.33 | 0.04 | 0.0003 | 13.0 | 2.4 | 1.4 | 15.3 | 0.002 | 0.002 | 0.01 | 0.01 | <0.001 | 0.01 | 1.4 | balance |
| Comp. Ex. 7 | 0.32 | 0.02 | 0.0003 | 8.7 | 0.4 | 1.2 | 15.3 | 0.002 | 0.002 | 0.01 | 0.01 | <0.001 | 0.01 | 1.2 | balance |
| Comp. Ex. 8 | 0.29 | 0.01 | 0.0003 | 8.8 | 5.0 | 1.3 | 15.0 | 0.002 | 0.002 | 0.01 | 0.01 | <0.001 | 0.01 | 1.3 | balance |
| Comp. Ex. 9 | 0.29 | 0.04 | 0.0003 | 8.5 | 2.2 | 0.3 | 15.1 | 0.002 | 0.002 | 0.01 | 0.01 | <0.001 | 0.01 | 0.3 | balance |
| Comp. Ex. 10 | 0.32 | 0.02 | 0.0004 | 8.8 | 2.4 | 3.4 | 15.2 | 0.002 | 0.002 | 0.01 | 0.01 | <0.001 | 0.01 | 3.4 | balance |
| Comp. Ex. 11 | 0.29 | 0.02 | 0.0003 | 8.8 | 2.4 | 1.2 | 8.0 | 0.002 | 0.002 | 0.01 | 0.01 | <0.001 | 0.01 | 1.2 | balance |
| Comp. Ex. 12 | 0.33 | 0.04 | 0.0003 | 8.8 | 2.4 | 1.4 | 23.0 | 0.002 | 0.002 | 0.01 | 0.01 | <0.001 | 0.01 | 1.4 | balance |
| Comp. Ex. 13 | 0.29 | 0.01 | 0.0003 | 8.5 | 2.4 | 1.4 | 14.9 | 0.24 | 0.002 | 0.01 | 0.01 | <0.001 | 0.01 | 1.4 | balance |
| Comp. Ex. 14 | 0.29 | 0.04 | 0.0004 | 8.7 | 2.3 | 1.4 | 15.3 | 0.002 | 0.23 | 0.01 | 0.01 | <0.001 | 0.01 | 1.4 | balance |
| Comp. Ex. 15 | 0.30 | 0.04 | 0.0004 | 8.8 | 4.0 | 1.4 | 15.0 | 0.002 | 0.95 | 0.01 | 0.01 | <0.001 | 0.01 | 1.4 | balance |
| Comp. Ex. 16 | 0.32 | 0.04 | 0.0003 | 8.8 | 2.4 | 1.4 | 15.0 | 0.002 | 0.002 | 0.65 | 0.01 | <0.001 | 0.01 | 1.4 | balance |
| Comp. Ex. 17 | 0.33 | 0.01 | 0.0003 | 8.7 | 2.4 | 1.3 | 14.9 | 0.002 | 0.002 | 0.01 | 0.7 | <0.001 | 0.01 | 1.3 | balance |
| Comp. Ex. 18 | 0.32 | 0.03 | 0.0003 | 8.7 | 2.3 | 1.4 | 15.0 | 0.002 | 0.002 | 0.01 | 0.01 | 0.009 | 0.01 | 1.4 | balance |
| Comp. Ex. 19 | 0.32 | 0.03 | 0.0003 | 8.7 | 2.3 | 0.5 | 15.0 | 0.002 | 0.002 | 0.01 | 0.01 | 0.009 | 0.50 | 0.8 | balance |
| Comp. Ex. 20 | 0.32 | 0.03 | 0.0003 | 8.8 | 2.3 | 1.4 | 15.0 | 0.002 | 0.002 | 0.01 | 0.01 | 0.009 | 1.60 | 2.2 | balance |

[2. Testing Methods]

[2.1. Hardness]

Hardness measurements were made in accordance with the Vickers hardness testing method defined in JIS Z 2244: 2009. The measurements were carried out under a load of 4.9N at positions of one-fourth the diameter of a ϕ22 round bar. The average of values measured at 5 points was adopted as hardness.

[2.2. Tensile Testing]

Tensile testing was carried out in accordance with the metal tensile testing method defined in JIS Z 2241:2011. The testing temperature adopted herein was room temperature (23° C.).

[2.3. Low-cycle Fatigue (LCF) Testing]

Materials for test specimens were taken so that the length directions of test specimens were parallel to the directions of extension during the forging of the materials, and therefrom test specimens were made according to JIS law (JIS Z 2242:2005). By the use of these test specimens, the testing was carried out. The temperature during the testing was set at 200° C. In addition, a triangular form was chosen as the skew waveform, and the frequency setting was adjusted to 0.1 Hz and the distortion setting was adjusted to 0.9%.

[2.4. Chemical Extraction Testing]

Two or more test specimens each measuring 15 mm by 15 mm by 0.1 mm (thickness) were taken, and accretion on their surfaces was removed by pickling. The resulting test specimens (5 g in total) were dissolved chemically in bromine methanol, and filtered through an extraction filter having a pore size of ϕ5 μm. The extraction residue was observed under SEM (Scanning Electron Microscope), and examined for inclusions in the test specimens. In order to identify the inclusions, EDX analysis was conducted.

Cases where AlN or TiN residues greater than 5 m in maximum diameter were left on the filter were assessed as fail, while cases where neither AlN nor TiN residues greater than 5 m in maximum diameter were left on the filter were assessed as pass.

[2.5. Fracture Toughness Testing]

Materials for test specimens were taken so that the notch directions of test specimens were parallel to the directions of extension during the forging of the materials, and therefrom compact tension (CT) test specimens were made according to ASTM law (ASTM E399). By the use of these test specimens, the testing was conducted and values of fracture toughness $K_1c$ were determined. As the testing temperature, room temperature (23° C.) was chosen.

[3. Results]

Results obtained are shown in Table 3 and Table 4. The following can be seen from Table 3 and Table 4. (1) In the case where C contents are low, precipitation strengthening attributed to carbides cannot be obtained to a sufficient degree, and thus, sufficient strength cannot be attained. On the other hand, in the case where C contents are excessively high, strength becomes too high, and there occurs serious reduction in ductility. (2) As to Si, incorporation thereof contributes to improvement in strength, but in the case where Si contents become too high, there occurs serious reduction in ductility.

(3) In the case where S, Al and Ti contents are excessively high, sulfides and nitrides of these elements are formed to result in serious reduction in low-cycle fatigue life. Accordingly, S, Al and Ti contents are required to be adjusted to 0.0010 mass % or less, 0.10 mass % or less and 0.10 mass % or less, respectively.

(4) In the case where Ni contents are low, sufficient ductility cannot be achieved. On the other hand, too high Ni contents make it impossible to achieve sufficient strength.

(5) Mo and Cr are elements which form carbides, and their low contents make it impossible to achieve sufficient strength. On the other hand, too high Mo contents not only result in excess precipitation of its carbides but also cause segregation to remain. Thus, there occurs serious reduction in ductility (elongation). As to Cr, too high Cr contents make it impossible to achieve sufficient strength.

(6) As to Co, low Co contents fail in precipitation of a sufficient amount of carbides to result in lack of strength. On the other hand, excess addition of Co brings about insufficient ductility (elongation), and besides, it causes a rise in production costs because the use of expensive Co alloys becomes necessary. However, by adjusting the Co content to 11.0 mass % or more, it becomes possible to achieve high fracture toughness value as well as high strength, high elongation and high fatigue resistance.

(7) B may be added for the purpose of improving hot workability, but excess addition thereof causes degradation in ductility.

(8) As to V and Nb, as long as they are each incorporated in a range of 0.3 mass % or less, they contribute to increase in strength with increase in their contents. However, in the case where their addition amounts become excess, there occurs serious reduction in strength.

TABLE 3

| | Hardness | Tensile Testing | | LCF Fracture Life | Fracture Toughness | Chemical Extraction | |
|---|---|---|---|---|---|---|---|
| | (HV) | Tensile Strength (MPa) | Elongation (%) | $\times 10^4$ (cycle) | Value (MPa√m) | Testing | Cost |
| Ex. 1 | 660 | 2305 | 13 | >20 | 38 | pass | pass |
| Ex. 2 | 710 | 2430 | 11 | >20 | 35 | pass | pass |
| Ex. 3 | 680 | 2348 | 12 | >20 | 36 | pass | pass |
| Ex. 4 | 680 | 2348 | 11 | >20 | 37 | pass | pass |
| Ex. 5 | 705 | 2438 | 12 | >20 | 38 | pass | pass |
| Ex. 6 | 680 | 2348 | 10 | >20 | 38 | pass | pass |
| Ex. 7 | 660 | 2305 | 11 | >20 | 36 | pass | pass |
| Ex. 8 | 700 | 2420 | 10 | >20 | 36 | pass | pass |
| Ex. 9 | 670 | 2312 | 12 | >20 | 36 | pass | pass |
| Ex. 10 | 690 | 2384 | 11 | >20 | 38 | pass | pass |
| Ex. 11 | 671 | 2320 | 12 | >20 | 36 | pass | pass |
| Ex. 12 | 700 | 2420 | 10 | >20 | 36 | pass | pass |
| Ex. 13 | 679 | 2344 | 11 | >20 | 32 | pass | pass |
| Ex. 14 | 685 | 2366 | 10 | >20 | 35 | pass | pass |
| Ex. 15 | 691 | 2400 | 11 | >20 | 38 | pass | pass |
| Ex. 16 | 670 | 2312 | 12 | >20 | 38 | pass | pass |
| Ex. 17 | 678 | 2341 | 11 | >20 | 36 | pass | pass |
| Ex. 18 | 660 | 2310 | 10 | >20 | 35 | pass | pass |
| Ex. 19 | 674 | 2326 | 12 | >20 | 42 | pass | pass |
| Ex. 20 | 686 | 2370 | 12 | >20 | 40 | pass | pass |
| Ex. 21 | 667 | 2301 | 10 | >20 | 36 | pass | pass |
| Ex. 22 | 675 | 2340 | 10 | >20 | 35 | pass | pass |
| Ex. 23 | 666 | 2306 | 11 | >20 | 38 | pass | pass |
| Ex. 24 | 676 | 2310 | 10 | >20 | 36 | pass | pass |
| Ex. 25 | 670 | 2312 | 13 | >20 | 30 | pass | pass |
| Ex. 26 | 720 | 2450 | 10 | >20 | 36 | pass | pass |
| Ex. 27 | 690 | 2380 | 10 | >20 | 38 | pass | pass |
| Ex. 28 | 685 | 2370 | 10 | >20 | 35 | pass | pass |

TABLE 4

| | | Tensile Testing | | | Fracture | | |
|---|---|---|---|---|---|---|---|
| | Hardness (HV) | Tensile Strength (MPa) | Elongation (%) | LCF Fracture Life $\times 10^4$ (cycle) | Toughness Value (MPa√m) | Chemical Extraction Testing | Cost |
| Comp. Ex. 1 | 590 | 2024 | 10 | 13 | 35 | pass | pass |
| Comp. Ex. 2 | 740 | 2450 | 5 | 18 | 22 | pass | pass |
| Comp. Ex. 3 | 748 | 2455 | 4 | >20 | 18 | pass | pass |
| Comp. Ex. 4 | 660 | 2276 | 11 | 5 | 37 | pass | pass |
| Comp. Ex. 5 | 660 | 2276 | 5 | >20 | 39 | pass | pass |
| Comp. Ex. 6 | 570 | 1952 | 12 | 15 | 35 | pass | pass |
| Comp. Ex. 7 | 600 | 2060 | 11 | 12 | 32 | pass | pass |
| Comp. Ex. 8 | 579 | 1984 | 12 | 10 | 30 | pass | pass |
| Comp. Ex. 9 | 598 | 2053 | 11 | 12 | 30 | pass | pass |
| Comp. Ex. 10 | 700 | 2420 | 6 | >20 | 18 | pass | pass |
| Comp. Ex. 11 | 588 | 2017 | 12 | 16 | 34 | pass | pass |
| Comp. Ex. 12 | 740 | 2456 | 3 | >20 | 20 | pass | fail |
| Comp. Ex. 13 | 710 | 2456 | 10 | 2 | 21 | fail | pass |
| Comp. Ex. 14 | 713 | 2450 | 12 | 3 | 15 | fail | pass |
| Comp. Ex. 15 | 720 | 2468 | 11 | 3 | 19 | fail | pass |
| Comp. Ex. 16 | 571 | 1956 | 12 | 10 | 31 | pass | pass |
| Comp. Ex. 17 | 605 | 2078 | 11 | 10 | 38 | pass | pass |
| Comp. Ex. 18 | 660 | 2276 | 5 | 15 | 39 | pass | pass |
| Comp. Ex. 19 | 630 | 2205 | 10 | 15 | 32 | pass | pass |
| Comp. Ex. 20 | 640 | 2410 | 5 | 15 | 31 | pass | pass |

Examples 51 to 80 and Comparative Examples 51 to 69

[1. Preparation of Test Specimens and Testing Methods]

Test specimens were made in the same manners as in Example 1, except that alloys having the compositions shown in Tables 5 to 7 were used and the aging treatment was performed under conditions mentioned below. On the test specimens thus made, evaluations of their characteristics were performed according to the same methods as in Example 1. The conditions for the aging treatment were (a) 450° C.×9 hours in Examples 58 and 59 and Comparative Example 55, while they are (b) 450° C.×5 hours in Examples 51 to 57 and 60 to 80 and Comparative Examples 51 to 54 and 56 to 59.

TABLE 5

| | Composition (mass %) | | | | | | | | | | | | | | |
|---|---|---|---|---|---|---|---|---|---|---|---|---|---|---|---|
| | C | Si | S | Ni | Cr | Mo | Co | Ti | Al | V | Nb | B | W | Mo + W/2 | Fe |
| Ex. 51 | 0.20 | 0.01 | 0.0004 | 14.0 | 2.4 | 1.5 | 14.9 | 0.002 | 0.002 | 0.23 | 0.01 | <0.001 | 0.01 | 1.5 | balance |
| Ex. 52 | 0.31 | 0.02 | 0.0005 | 13.2 | 2.4 | 1.6 | 19.0 | 0.002 | 0.002 | 0.21 | 0.01 | <0.001 | 0.01 | 1.6 | balance |
| Ex. 53 | 0.34 | 0.02 | 0.0005 | 13.0 | 2.3 | 1.5 | 15.0 | 0.002 | 0.002 | 0.27 | 0.01 | <0.001 | 0.01 | 1.5 | balance |
| Ex. 54 | 0.30 | 0.01 | 0.0005 | 11.5 | 2.3 | 1.6 | 17.8 | 0.002 | 0.002 | 0.22 | 0.01 | <0.001 | 0.01 | 1.6 | balance |
| Ex. 55 | 0.32 | 0.07 | 0.0005 | 13.0 | 1.9 | 1.5 | 15.4 | 0.002 | 0.002 | 0.21 | 0.01 | <0.001 | 0.01 | 1.5 | balance |
| Ex. 56 | 0.30 | 0.51 | 0.0005 | 15.5 | 2.4 | 1.5 | 14.5 | 0.002 | 0.002 | 0.21 | 0.01 | <0.001 | 0.01 | 1.5 | balance |
| Ex. 57 | 0.30 | 0.01 | 0.0009 | 14.0 | 2.4 | 1.4 | 15.0 | 0.002 | 0.002 | 0.20 | 0.01 | <0.001 | 0.01 | 1.4 | balance |
| Ex. 58 | 0.33 | 0.01 | 0.0005 | 6.5 | 2.6 | 1.5 | 16.5 | 0.002 | 0.002 | 0.24 | 0.01 | <0.001 | 0.01 | 1.5 | balance |
| Ex. 59 | 0.32 | 0.01 | 0.0005 | 8.3 | 2.5 | 1.6 | 14.1 | 0.002 | 0.002 | 0.24 | 0.01 | <0.001 | 0.01 | 1.6 | balance |
| Ex. 60 | 0.32 | 0.01 | 0.0005 | 13.0 | 2.5 | 1.5 | 15.0 | 0.002 | 0.002 | 0.24 | 0.01 | <0.001 | 0.01 | 1.5 | balance |
| Ex. 61 | 0.32 | 0.01 | 0.0005 | 15.3 | 2.5 | 1.6 | 14.0 | 0.002 | 0.002 | 0.24 | 0.01 | <0.001 | 0.01 | 1.6 | balance |
| Ex. 62 | 0.30 | 0.01 | 0.0005 | 13.0 | 1.2 | 1.6 | 15.3 | 0.002 | 0.002 | 0.24 | 0.01 | <0.001 | 0.01 | 1.6 | balance |
| Ex. 63 | 0.32 | 0.01 | 0.0005 | 12.0 | 3.7 | 1.5 | 16.0 | 0.002 | 0.002 | 0.22 | 0.01 | <0.001 | 0.01 | 1.5 | balance |
| Ex. 64 | 0.30 | 0.01 | 0.0003 | 11.4 | 2.4 | 1.2 | 15.2 | 0.002 | 0.002 | 0.20 | 0.01 | <0.001 | 0.01 | 1.2 | balance |
| Ex. 65 | 0.29 | 0.01 | 0.0003 | 12.2 | 2.4 | 1.8 | 15.6 | 0.002 | 0.002 | 0.20 | 0.01 | <0.001 | 0.01 | 1.8 | balance |

TABLE 6

| | Composition (mass %) | | | | | | | | | | | | | | |
|---|---|---|---|---|---|---|---|---|---|---|---|---|---|---|---|
| | C | Si | S | Ni | Cr | Mo | Co | Ti | Al | V | Nb | B | W | Mo + W/2 | Fe |
| Ex. 66 | 0.30 | 0.02 | 0.0005 | 11.2 | 2.4 | 1.4 | 9.5 | 0.002 | 0.002 | 0.20 | 0.01 | <0.001 | 0.01 | 1.4 | balance |
| Ex. 67 | 0.30 | 0.02 | 0.0005 | 13.2 | 2.4 | 1.4 | 11.8 | 0.002 | 0.002 | 0.20 | 0.01 | <0.001 | 0.01 | 1.4 | balance |
| Ex. 68 | 0.30 | 0.02 | 0.0003 | 10.5 | 2.4 | 1.6 | 14.5 | 0.002 | 0.002 | 0.22 | 0.01 | <0.001 | 0.01 | 1.6 | balance |
| Ex. 69 | 0.31 | 0.01 | 0.0003 | 13.4 | 2.4 | 1.4 | 18.9 | 0.002 | 0.002 | 0.20 | 0.01 | <0.001 | 0.01 | 1.4 | balance |
| Ex. 70 | 0.32 | 0.05 | 0.0004 | 12.2 | 2.6 | 1.4 | 15.6 | 0.004 | 0.002 | 0.24 | 0.01 | <0.001 | 0.01 | 1.4 | balance |
| Ex. 71 | 0.34 | 0.01 | 0.0004 | 13.2 | 2.1 | 1.4 | 15.0 | 0.002 | 0.004 | 0.22 | 0.01 | <0.001 | 0.01 | 1.4 | balance |
| Ex. 72 | 0.29 | 0.04 | 0.0003 | 12.3 | 2.3 | 1.6 | 17.5 | 0.002 | 0.002 | 0.10 | 0.01 | <0.001 | 0.01 | 1.6 | balance |
| Ex. 73 | 0.33 | 0.01 | 0.0004 | 13.4 | 2.3 | 1.7 | 15.0 | 0.002 | 0.002 | 0.20 | 0.01 | <0.001 | 0.01 | 1.7 | balance |
| Ex. 74 | 0.30 | 0.01 | 0.0004 | 14.4 | 2.2 | 1.4 | 15.2 | 0.002 | 0.002 | 0.55 | 0.01 | <0.001 | 0.01 | 1.4 | balance |
| Ex. 75 | 0.29 | 0.02 | 0.0003 | 15.1 | 2.4 | 1.4 | 14.9 | 0.002 | 0.002 | 0.20 | 0.12 | <0.001 | 0.01 | 1.4 | balance |
| Ex. 76 | 0.33 | 0.02 | 0.0003 | 13.2 | 2.4 | 1.5 | 16.1 | 0.002 | 0.002 | 0.22 | 0.45 | <0.001 | 0.01 | 1.5 | balance |
| Ex. 77 | 0.33 | 0.02 | 0.0005 | 13.4 | 2.5 | 1.4 | 15.0 | 0.002 | 0.002 | 0.24 | 0.01 | <0.001 | 0.01 | 1.4 | balance |
| Ex. 78 | 0.33 | 0.02 | 0.0003 | 11.9 | 2.3 | 1.4 | 16.1 | 0.002 | 0.002 | 0.22 | 0.01 | 0.003 | 0.01 | 1.4 | balance |
| Ex. 79 | 0.32 | 0.04 | 0.0003 | 14.0 | 2.2 | 1.4 | 15.5 | 0.002 | 0.002 | 0.20 | 0.01 | <0.001 | 0.6 | 1.7 | balance |
| Ex. 80 | 0.33 | 0.04 | 0.0003 | 11.9 | 2.4 | 0.6 | 14.9 | 0.002 | 0.002 | 0.20 | 0.01 | <0.001 | 1.6 | 1.4 | balance |

TABLE 7

| | Composition (mass %) | | | | | | | | | | | | | | |
|---|---|---|---|---|---|---|---|---|---|---|---|---|---|---|---|
| | C | Si | S | Ni | Cr | Mo | Co | Ti | Al | V | Nb | B | W | Mo + W/2 | Fe |
| Comp. Ex. 51 | 0.12 | 0.01 | 0.0004 | 11.0 | 2.4 | 1.5 | 14.0 | 0.002 | 0.002 | 0.18 | 0.01 | <0.001 | 0.01 | 1.5 | balance |
| Comp. Ex. 52 | 0.45 | 0.01 | 0.0004 | 12.2 | 2.5 | 1.4 | 14.9 | 0.002 | 0.002 | 0.20 | 0.01 | <0.001 | 0.01 | 1.4 | balance |
| Comp. Ex. 53 | 0.32 | 1.20 | 0.0003 | 12.3 | 2.1 | 1.4 | 15.0 | 0.002 | 0.002 | 0.21 | 0.01 | <0.001 | 0.01 | 1.4 | balance |
| Comp. Ex. 54 | 0.33 | 0.03 | 0.003 | 14.4 | 2.7 | 1.4 | 15.0 | 0.002 | 0.002 | 0.20 | 0.01 | <0.001 | 0.01 | 1.4 | balance |
| Comp. Ex. 55 | 0.33 | 0.02 | 0.0003 | 5.0 | 2.4 | 1.4 | 14.0 | 0.002 | 0.002 | 0.20 | 0.01 | <0.001 | 0.01 | 1.4 | balance |
| Comp. Ex. 56 | 0.33 | 0.02 | 0.0003 | 18.5 | 2.2 | 1.5 | 14.9 | 0.002 | 0.002 | 0.24 | 0.01 | <0.001 | 0.01 | 1.5 | balance |
| Comp. Ex. 57 | 0.33 | 0.02 | 0.0003 | 12.3 | 0.5 | 1.2 | 15.3 | 0.002 | 0.002 | 0.20 | 0.01 | <0.001 | 0.01 | 1.2 | balance |
| Comp. Ex. 58 | 0.32 | 0.02 | 0.0005 | 14.0 | 5.5 | 1.3 | 15.0 | 0.002 | 0.002 | 0.24 | 0.01 | <0.001 | 0.01 | 1.3 | balance |
| Comp. Ex. 59 | 0.33 | 0.04 | 0.0003 | 13.2 | 2.2 | 0.2 | 15.1 | 0.002 | 0.002 | 0.20 | 0.01 | <0.001 | 0.01 | 0.2 | balance |
| Comp. Ex. 60 | 0.33 | 0.02 | 0.0004 | 13.7 | 2.4 | 3.5 | 15.2 | 0.002 | 0.002 | 0.27 | 0.01 | <0.001 | 0.01 | 3.5 | balance |
| Comp. Ex. 61 | 0.30 | 0.02 | 0.0003 | 14.0 | 2.2 | 1.2 | 7.6 | 0.002 | 0.002 | 0.20 | 0.01 | <0.001 | 0.01 | 1.2 | balance |
| Comp. Ex. 62 | 0.29 | 0.04 | 0.0003 | 12.5 | 2.2 | 1.3 | 23.0 | 0.002 | 0.002 | 0.19 | 0.01 | <0.001 | 0.01 | 1.3 | balance |
| Comp. Ex. 63 | 0.33 | 0.04 | 0.0003 | 13.0 | 2.5 | 1.3 | 14.9 | 0.3 | 0.002 | 0.24 | 0.01 | <0.001 | 0.01 | 1.3 | balance |
| Comp. Ex. 64 | 0.32 | 0.04 | 0.0004 | 13.2 | 2.3 | 1.4 | 15.3 | 0.002 | 0.25 | 0.19 | 0.01 | <0.001 | 0.01 | 1.4 | balance |
| Comp. Ex. 65 | 0.33 | 0.04 | 0.0003 | 11.9 | 2.4 | 1.3 | 14.0 | 0.002 | 0.002 | 0.68 | 0.01 | <0.001 | 0.01 | 1.3 | balance |
| Comp. Ex. 66 | 0.29 | 0.01 | 0.0003 | 11.0 | 2.5 | 1.3 | 13.2 | 0.002 | 0.002 | 0.24 | 0.66 | <0.001 | 0.01 | 1.3 | balance |
| Comp. Ex. 67 | 0.29 | 0.03 | 0.0003 | 14.0 | 2.3 | 1.4 | 15.0 | 0.002 | 0.002 | 0.20 | 0.01 | 0.007 | 0.01 | 1.4 | balance |
| Comp. Ex. 68 | 0.28 | 0.02 | 0.0003 | 13.2 | 2.3 | 0.5 | 15.0 | 0.002 | 0.002 | 0.20 | 0.01 | <0.001 | 0.4 | 0.7 | balance |
| Comp. Ex. 69 | 0.29 | 0.02 | 0.0003 | 11.0 | 2.4 | 1.6 | 15.0 | 0.002 | 0.002 | 0.22 | 0.01 | <0.001 | 1.50 | 2.4 | balance |

[2. Results]

Testing results are shown in Tables 8 to 10. In the cases where 0.020 mass %<V+Nb≤0.60 mass %, it can be seen from Tables 8 to 10 that Examples with Co≥11.5 mass % are superior in not only tensile strength but also fracture toughness (35 MPa√m or higher) to Example 66 with Co=9.5 mass %.

TABLE 8

| | | Tensile Testing | | Fracture | | | |
|---|---|---|---|---|---|---|---|
| | Hardness (HV) | Tensile Strength (MPa) | Elongation (%) | LCF Fracture Life $\times 10^4$ (cycle) | Toughness Value (MPa√m) | Chemical Extraction Testing | Cost |
| Ex. 51 | 650 | 2305 | 12 | >20 | 41 | pass | pass |
| Ex. 52 | 720 | 2467 | 11 | >20 | 42 | pass | pass |
| Ex. 53 | 691 | 2360 | 11 | >20 | 40 | pass | pass |
| Ex. 54 | 680 | 2340 | 10 | >20 | 39 | pass | pass |
| Ex. 55 | 710 | 2400 | 11 | >20 | 39 | pass | pass |
| Ex. 56 | 730 | 2420 | 9 | >20 | 36 | pass | pass |
| Ex. 57 | 692 | 2340 | 12 | >20 | 42 | pass | pass |
| Ex. 58 | 710 | 2405 | 11 | >20 | 40 | pass | pass |
| Ex. 59 | 720 | 2410 | 13 | >20 | 42 | pass | pass |
| Ex. 60 | 691 | 2324 | 11 | >20 | 39 | pass | pass |
| Ex. 61 | 676 | 2349 | 12 | >20 | 44 | pass | pass |
| Ex. 62 | 691 | 2350 | 12 | >20 | 40 | pass | pass |
| Ex. 63 | 680 | 2367 | 11 | >20 | 44 | pass | pass |
| Ex. 64 | 670 | 2355 | 11 | >20 | 40 | pass | pass |
| Ex. 65 | 712 | 2399 | 13 | >20 | 40 | pass | pass |

TABLE 9

| | | Tensile Testing | | Fracture | | | |
|---|---|---|---|---|---|---|---|
| | Hardness (HV) | Tensile Strength (MPa) | Elongation (%) | LCF Fracture Life $\times 10^4$ (cycle) | Toughness Value (MPa√m) | Chemical Extraction Testing | Cost |
| Ex. 66 | 692 | 2380 | 13 | >20 | 32 | pass | pass |
| Ex. 67 | 689 | 2377 | 12 | >20 | 37 | pass | pass |
| Ex. 68 | 710 | 2400 | 13 | >20 | 40 | pass | pass |
| Ex. 69 | 708 | 2412 | 13 | >20 | 44 | pass | pass |
| Ex. 70 | 688 | 2364 | 11 | >20 | 39 | pass | pass |
| Ex. 71 | 681 | 2387 | 13 | >20 | 40 | pass | pass |
| Ex. 72 | 690 | 2390 | 11 | >20 | 42 | pass | pass |
| Ex. 73 | 700 | 2410 | 12 | >20 | 44 | pass | pass |
| Ex. 74 | 690 | 2380 | 12 | >20 | 40 | pass | pass |
| Ex. 75 | 690 | 2401 | 11 | >20 | 42 | pass | pass |
| Ex. 76 | 688 | 2412 | 11 | >20 | 39 | pass | pass |
| Ex. 77 | 683 | 2378 | 13 | >20 | 42 | pass | pass |
| Ex. 78 | 679 | 2369 | 11 | >20 | 39 | pass | pass |
| Ex. 79 | 700 | 2394 | 11 | >20 | 44 | pass | pass |
| Ex. 80 | 699 | 2411 | 12 | >20 | 41 | pass | pass |

TABLE 10

| | | Tensile Testing | | Fracture | | | |
|---|---|---|---|---|---|---|---|
| | Hardness (HV) | Tensile Strength (MPa) | Elongation (%) | LCF Fracture Life $\times 10^4$ (cycle) | Toughness Value (MPa√m) | Chemical Extraction Testing | Cost |
| Comp. Ex. 51 | 600 | 2060 | 9 | 11 | 32 | pass | pass |
| Comp. Ex. 52 | 739 | 2440 | 3 | 15 | 30 | pass | pass |
| Comp. Ex. 53 | 749 | 2432 | 5 | 17 | 29 | pass | pass |
| Comp. Ex. 54 | 669 | 2308 | 10 | 6 | 25 | pass | pass |
| Comp. Ex. 55 | 660 | 2276 | 6 | >20 | 31 | pass | pass |
| Comp. Ex. 56 | 590 | 2024 | 11 | 15 | 30 | pass | pass |
| Comp. Ex. 57 | 610 | 2096 | 12 | 12 | 29 | pass | pass |
| Comp. Ex. 58 | 580 | 1988 | 11 | 10 | 24 | pass | pass |
| Comp. Ex. 59 | 592 | 2031 | 10 | 11 | 29 | pass | pass |
| Comp. Ex. 60 | 730 | 2528 | 2 | 17 | 30 | pass | pass |
| Comp. Ex. 61 | 580 | 1988 | 12 | 18 | 30 | pass | pass |
| Comp. Ex. 62 | 736 | 2449 | 3 | 13 | 29 | pass | fail |
| Comp. Ex. 63 | 710 | 2456 | 5 | 5 | 21 | fail | pass |
| Comp. Ex. 64 | 712 | 2440 | 8 | 3 | 26 | fail | pass |
| Comp. Ex. 65 | 580 | 1988 | 11 | 10 | 30 | pass | pass |
| Comp. Ex. 66 | 590 | 2024 | 12 | 10 | 32 | pass | pass |
| Comp. Ex. 67 | 652 | 2247 | 12 | 13 | 30 | pass | pass |
| Comp. Ex. 68 | 630 | 2210 | 10 | 16 | 26 | pass | pass |
| Comp. Ex. 69 | 739 | 2432 | 3 | 13 | 22 | pass | pass |

While embodiments of the present invention have been described above in detail, the present invention should not be construed as being limited to the above embodiments in any way, and it will be apparent that various changes and modifications can be made without departing from the spirit and scope of the invention.

The present application is based on Japanese patent application No. 2015-104464 filed on May 22, 2015 and Japanese patent application No. 2015-247123 filed on Dec. 18, 2015, and contents thereof are incorporated herein by reference.

INDUSTRIAL APPLICABILITY

Because the maraging steels according to the present invention have very high tensile strengths of 2,300 MPa or higher, it is possible to use them as members of which high strength is required, such as structural materials for spacecraft and aircraft, parts for continuously variable transmission of automobile engines, materials for high-pressure vessels, materials for tools, and molds.

More specifically, the maraging steels according to the present invention can be used for engine shafts of aircraft, motor cases of solid rockets, lifting apparatus of aircraft, engine valve springs, heavy-duty bolts, transmission shafts, high-pressure vessels for petrochemical industry, and so on.

What is claimed is:

1. A maraging steel consisting of:

as essential components, 0.20 mass %≤C5.1≤0.35 mass %, 9.0 mass %≤Co≤20.0 mass %, 1.0 mass %≤(Mo+W/2)≤2.0 mass %, 1.0 mass %≤Cr≤4.0 mass %, and a certain amount of Ni, and as optional components, Al≤0.10 mass %, Ti≤0.10 mass %, S≤0.0010 mass %, N≤0.0020 mass %, V+Nb≤0.60 mass %, B≤0.0050 mass %, and Si≤1.0 mass %, with a balance being Fe and inevitable impurities, wherein, in a case where contents of V and Nb satisfy V+Nb≤0.020 mass %, an amount of Ni is:

6.0 mass %≤Ni≤9.4 mass %, and wherein, in a case where the contents of V and Nb satisfy 0.020 mass %<V+Nb≤0.60 mass %, the amount of Ni is:

6.0mass %≤Ni≤16.0 mass %.

2. The maraging steel according to claim 1, wherein the content of V satisfies:

0.10 mass %≤V≤0.60 mass %.

3. The maraging steel according to claim 1, wherein the content of Nb satisfies:

0.10 mass %≤Nb≤0.60 mass %.

4. The maraging steel according to claim 1, having a tensile strength of at least 2,300 MPa at 23° C.

5. The maraging steel according to claim 1, having an elongation of at least 8% at 23° C.

6. The maraging steel according to claim 1, which is free of AlN and TiN inclusions measuring 5 μm or larger in a maximum diameter.

7. The maraging steel according to claim 1, wherein a content of B satisfies:

0.0010 mass %≤B≤0.0050 mass %.

8. The maraging steel according to claim 1, wherein a content of Si satisfies:

0.30 mass %≤Si≤1.0 mass %.

9. The maraging steel according to claim 1, used as an engine shaft of an aircraft.

10. The maraging steel according to claim 1, wherein the contents of V and Nb satisfy V+Nb≤0.020 mass %.

11. The maraging steel according to claim 1, wherein the contents of V and Nb satisfy 0.020 mass %≤V+Nb≤0.60 mass %.

12. The maraging steel according to claim 1, wherein the essential components include Mo and W.

13. The maraging steel according to claim 12, wherein 1.0 mas %≤(Mo+W/2) ≤1.6 mass %.

14. The maraging steel according to claim 1, wherein 1.0 mass %≤(Mo+W/2)≤1.6 mass %.

15. The maraging steel according to claim 1, wherein the amount of Ni is:

6.0 mass %≤Ni≤9.0 mass %.

* * * * *